US008408371B2

(12) United States Patent
Schultheiss et al.

(10) Patent No.: US 8,408,371 B2
(45) Date of Patent: Apr. 2, 2013

(54) FAN CLUTCH

(75) Inventors: Gerold Schultheiss, Pforzheim (DE); Joerg Angermaier, Illingen-Schuetzingen (DE); Eberhard Sixt, Magstadt (DE); Sven Setzer, Muehlacker (DE)

(73) Assignee: Behr GmbH & Co. KG, Stuttgart (DE)

( * ) Notice: Subject to any disclaimer, the term of this patent is extended or adjusted under 35 U.S.C. 154(b) by 674 days.

(21) Appl. No.: 12/510,813

(22) Filed: Jul. 28, 2009

(65) Prior Publication Data

US 2010/0018826 A1 Jan. 28, 2010

(30) Foreign Application Priority Data

Jul. 28, 2008 (DE) ..... 10 2008 035 185

(51) Int. Cl.
*F04D 29/58* (2006.01)
*F16D 37/00* (2006.01)

(52) U.S. Cl. ..... 192/58.4; 416/169 A; 416/244 R; 123/41.11

(58) Field of Classification Search ..... 192/58.4; 416/169 A, 244 R; 123/41.11
See application file for complete search history.

(56) References Cited

U.S. PATENT DOCUMENTS

| | | | | | |
|---|---|---|---|---|---|
| 4,169,693 | A * | 10/1979 | Brubaker | 416/93 R |
| 4,760,905 | A * | 8/1988 | Gob | 192/58.684 |
| 5,237,965 | A * | 8/1993 | Harima | 192/58.682 |
| 5,701,985 | A * | 12/1997 | Martin | 192/58.681 |
| 5,704,461 | A * | 1/1998 | Vatsaas et al. | 192/85.23 |
| 5,893,441 | A * | 4/1999 | Reeb | 192/58.43 |
| 5,896,965 | A * | 4/1999 | Gopalswamy et al. | 192/58.41 |
| 6,173,823 | B1 * | 1/2001 | Moser et al. | 192/58.4 |
| 6,530,748 | B2 * | 3/2003 | Light et al. | 192/58.682 |
| 6,679,365 | B2 * | 1/2004 | Katoh et al. | 192/58.682 |

FOREIGN PATENT DOCUMENTS

| | | |
|---|---|---|
| DE | 2 361 481 | 6/1974 |
| DE | 197 53 721 A1 | 6/1999 |
| DE | 696 25 723 T2 | 8/2003 |
| DE | 103 38 432 A1 | 3/2004 |
| EP | 0 701 064 A1 | 3/1996 |
| GB | 1 401 069 | 7/1975 |
| WO | WO 97/16650 | 5/1997 |

* cited by examiner

*Primary Examiner* — Justin Holmes
*Assistant Examiner* — Jacob S Scott
(74) *Attorney, Agent, or Firm* — Muncy, Geissler, Olds & Lowe, PLLC

(57) ABSTRACT

A fan clutch is provided to which a fan may be removably attached with the aid of a flange ring, the fan clutch having a housing that comprises a first front housing part and a second rear housing part to which the flange ring is attachable with the aid of connecting elements. The housing has circumferential attachment niches which are situated in an offset manner in the circumferential direction on both the front and the back of the housing and into which attachment tabs situated on the flange ring are insertable either from the front of the fan clutch or from the rear thereof.

16 Claims, 5 Drawing Sheets

FAN CLUTCH

This nonprovisional application claims priority under 35 U.S.C. §119(a) to German Patent Application No. 10 2008 035 185.7, which was filed in Germany on Jul. 28, 2008, and which is herein incorporated by reference.

BACKGROUND OF THE INVENTION

1. Field of the Invention

The invention relates to a fan clutch.

2. Related Art

A fan clutch is known from DE 103 38 432 A1, which is incorporated herein by reference, and which is designed as a fluid friction clutch, is used in a cooling system of a motor vehicle. The fan clutch is driven by the motor vehicle engine and drives a fan attached to the clutch housing as a function of the cooling requirements of the cooling system. This attachment is via a flange ring which, on the one hand, is embedded into the fan hub and, on the other hand, is attached to the clutch housing in a manner that allows it to be removed, in particular with the aid of screws. The attachment is either on the back of the clutch (FIG. 1 of DE 103 38 432 A1), i.e. on the side facing the engine, or on the front of the clutch (FIGS. 8 and 9 of DE 103 38 432 A1).

A further fan clutch designed as a fluid friction clutch is known from DE 197 53 725 C2, which is incorporated herein by reference, and in which a fan is attached to the back of the clutch housing.

3. Description of the Background Art

For the purpose of attaching a conventional fan, attachment bores as well as machined surfaces which must be mounted on the front or back of the clutch, depending on the type of attachment, i.e. on one or another housing part, typically have to be provided in the coupling housing. This can require different housings, i.e. different diecasting moulds—in part for the same clutch—which increases the production costs. A further disadvantage is the fact that the fan clutch, i.e. the clutch and the fan, requires a great deal of effort to be disassembled if any maintenance and repair work is to be done. For example, this makes it substantially more difficult to replace a V-belt, which is situated between the fan and the engine and is used to drive auxiliary units.

SUMMARY OF THE INVENTION

It is therefore an object of the present invention to simplify the connection between the fan and clutch in a fan clutch, such that the fan may be mounted on and removed from the same clutch from the front as well as from the back. Likewise, it should be possible to attach, i.e. mount, fasteners in both directions. If possible, the axial position of the fan on the clutch should be the same whether it is mounted on the front or the back.

According to an embodiment of the invention, it is provided that attachment niches, with which attachment tabs extending inward from the fan flange ring engage, are situated on the front and the back of the fan clutch. The attachment niches on the front are offset in relation to the attachment niches on the back in the circumferential direction, i.e., they are situated in a "staggered" manner. This achieves the advantage that the fan may be mounted and attached to the same clutch from either the front or the back. The mounting and fastening directions are therefore preferably the same.

The attachment niches can be designed as recesses in the housing which are directed radially to the inside, so that they form notches facing inward from the circumference of the clutch. These attachment niches can have stop faces which are situated on a radial plane and act as stop surfaces for the attachment tabs of the flange ring. The axial position of the fan can be determined by the stop faces in the clutch housing. To ensure that the fan is always located in the same axial position whether it is mounted on the front or the back, the stop faces of the front attachment niches, on the one hand, and the stop face of the back attachment niches, on the other hand, can be spaced apart by an axial distance that corresponds to the wall thickness of the flange ring.

According to a further embodiment, the attachment screws for attaching the flange ring to the clutch housing may simultaneously form the connecting elements for connecting the two housing parts. This simplifies construction and reduces the number of components.

According to yet a further embodiment, a gap which runs in the circumferential direction and can be preferably dimensioned to be larger than the wall thickness of the flange ring, can be provided between the front and back attachment niches. This achieves the advantage that the fan may be mounted, for example from the front, subsequently rotated in the circumferential direction and removed again via the back attachment niches or attached from the back. The same is possible in the opposite direction, i.e. from the back to the front. The fan may thus be "screwed on" more or less in the axial direction via the clutch or, in other words, inserted in the manner of a quarter-turn fastener. This is advantageous, in particular, for disassembly in the event of maintenance or repair work. This is also advantageous for mounting the fan, in particular in the case of heavy units, since it enables the clutch to be mounted first and the fan to be attached to the clutch. The flexibility of the fan clutch is substantially improved thereby. At the same time, the unit costs are reduced, due to the use of standard tools for different types of attachment.

According to a further embodiment, the fan clutch can be designed as a fluid friction clutch which can include two housing parts, a drive wheel having a drive shaft and a working space in which a torque is transmittable by fluid friction. Fluid friction clutches of this type have proven to be particularly sturdy and reliable for driving a fan in motor vehicles.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
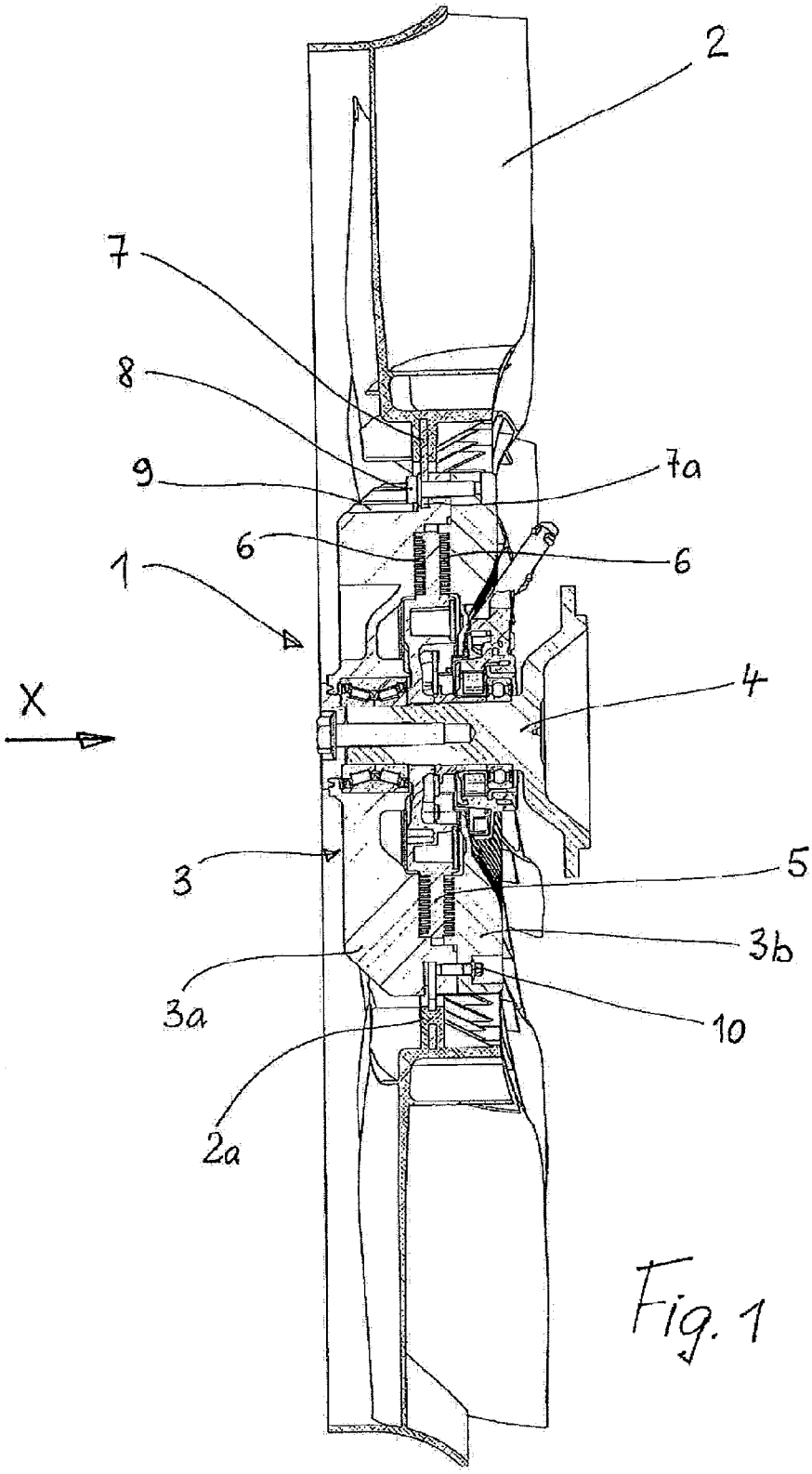
FIG. 1 shows an axial cross section of a fluid friction clutch having a fan attachment on the front.

FIG. 1 shows a fan clutch designed as a fluid friction clutch 1, to which a fan 2 designed as an axial fan, a so-called ring fan, is attached on the front of fan clutch 1, hereinafter referred to in short as clutch 1. Fan 2 and clutch 1 are part of a cooling system (which is not illustrated) for the internal combustion engine of a motor vehicle. Clutch 1 has a housing 3, which includes a first, front-facing housing part 3*a*, also referred to as front housing part 3*a*, and a second, rear or back housing part 3*b*. Front housing part 3*a* is mounted on a drive shaft 4, which is driven by the engine (not illustrated) of the motor vehicle, e.g. by the crankshaft thereof. A drive wheel 5, which together with the two housing parts 3*a*, 3*b* forms a working chamber 6 for transmitting a torque from drive shaft 4 to clutch housing 3 and thus to fan 2, is non-rotationally connected to drive shaft 4. For information of the functions of a fluid friction clutch and the regulation thereof, reference is hereby made to the relevant prior art, among other things to the two publications cited above. Fan 2, which is designed as a molded plastic part, has a hub 2*a* into which a flange ring 7 is embedded. Flange ring 7 has multiple, preferably six, attachment tabs 7*a* distributed along its inner circumference, these attachment tabs being used to connect the flange ring to clutch housing 3 with the aid of screws 8. Attachment tabs 7*a* engage with attachment niches 9, which are situated on the front of clutch 1, i.e. in front housing part 3*a*.

In the exemplary embodiment according to FIG. 1, fan 2 is mounted from the front, i.e. in direction X. Fan 2 is also attached to clutch housing 3 from the front by setting and tightening screws 8 situated on the circumference. Screws 8 are simultaneously used to connect the two housing parts 3*a*, 3*b* to each other—in addition to further attachment screws 10 situated on the circumference.

Figure 2:
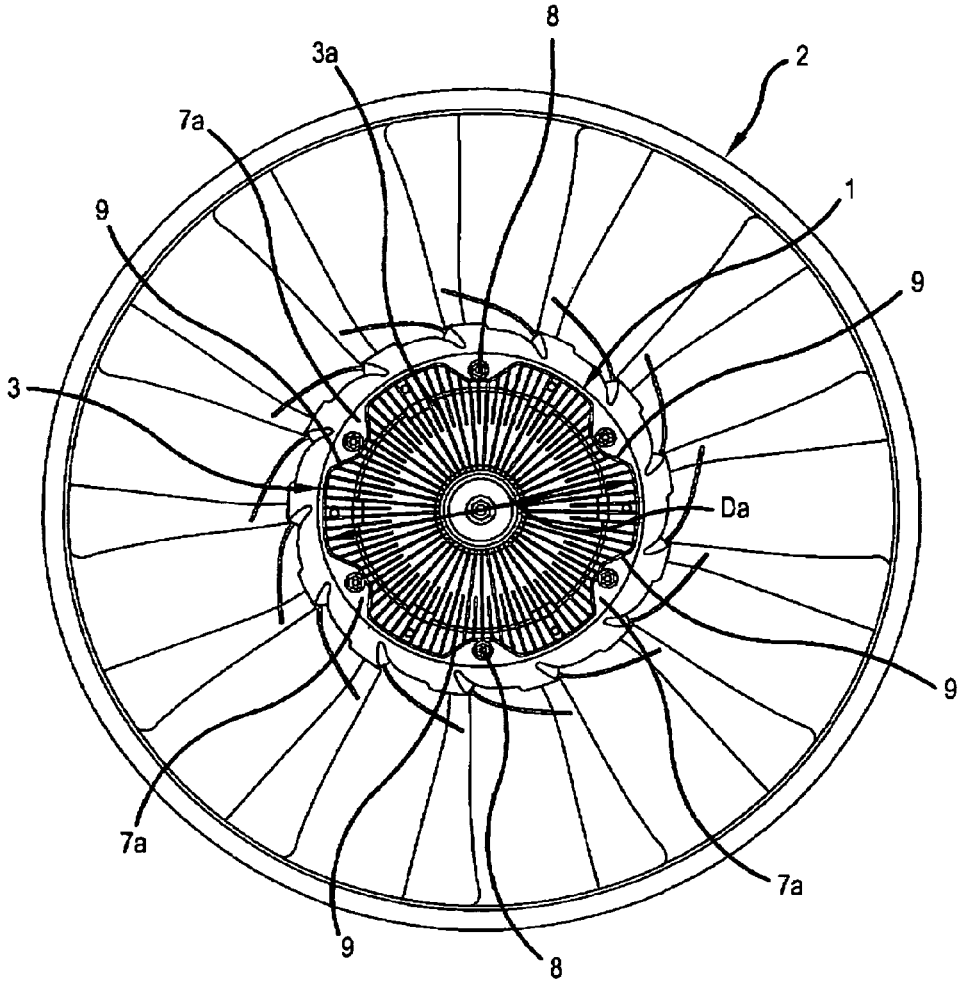
FIG. 2 shows a view in direction X of the front of the clutch including the fan.

FIG. 2 shows a view of clutch 1 having fan 2 according to FIG. 1 in direction X, i.e. in the direction of the front of clutch 1, which has an outer diameter $D_a$. The view shows six attachment niches 9, which are distributed evenly across the circumference and which form notches in the circumference of clutch housing 3. Attachment tabs 7*a*, which have more or less the same contour as attachment niches 9, engage with attachment niches 9. Attachment screws 8 fix attachment tabs 7*a*, and thus fan 2, in place axially and tangentially in relation to clutch 1.

Figure 3:
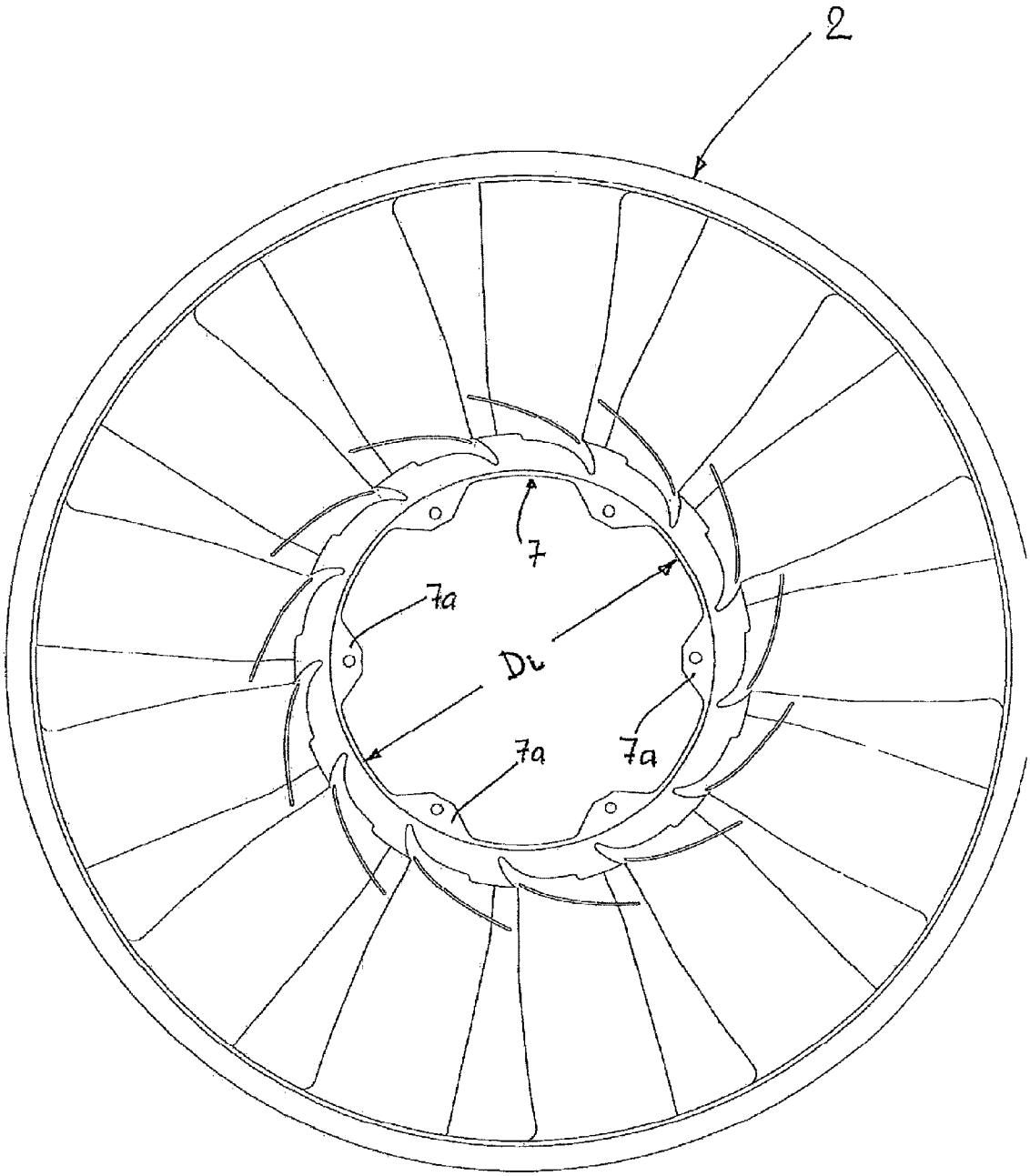
FIG. 3 shows a view of the fan including a flange ring (excluding the clutch)

FIG. 3 shows a view of fan 2, which includes flange ring 7—excluding clutch 1. Flange ring 7 has an inner diameter $D_i$, which is slightly larger than outer diameter $D_a$ (see FIG. 2) of clutch 1. Attachment tabs 7*a* extend radially to the inside from inner diameter $D_i$. The inner profile of flange ring 7 thus matches the outer profile of clutch housing 3, so that the two parts fit together in the axial direction.

Figure 4:
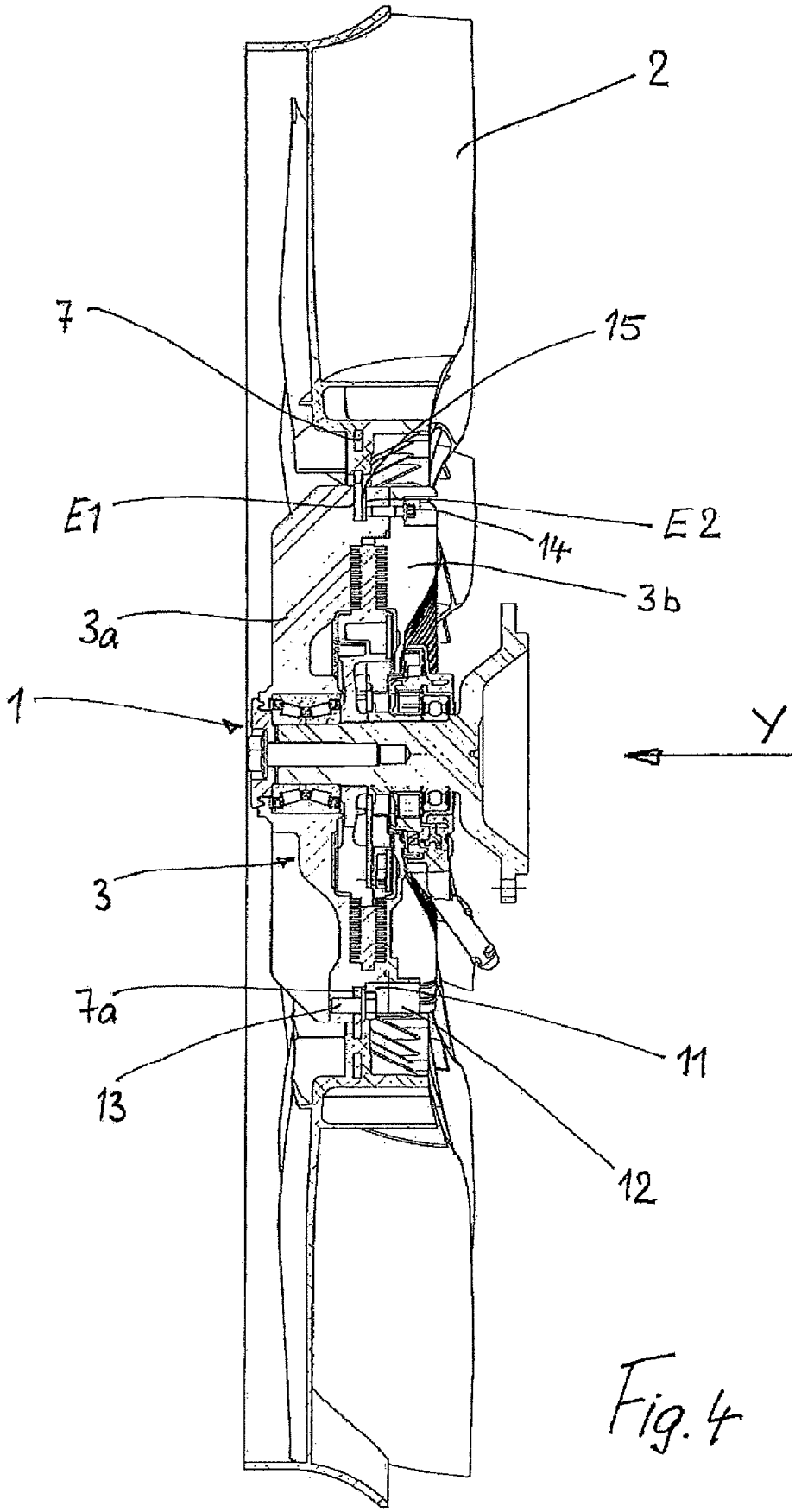
FIG. 4 shows an axial cross section of the fluid friction clutch having a fan attachment on the rear.

FIG. 4 shows a means of attaching fan 2 from the back for fan clutch 1, as illustrated in the cross-sectional view in FIG. 1, i.e., fan 2 is mounted on clutch housing 3 in the direction of arrow Y. Fan 2 is identical to fan 2 according to FIG. 1, i.e. it includes the same flange ring 7 having attachment tabs 7*a*. To accommodate and position attachment tabs 7*a*, front housing part has attachment niches 11, which are accessible from the back. Corresponding niches 12 are also provided in rear housing part 3*b*, so that the fan, or more precisely attachment tabs 7*a*, is insertable from the back. Fan 2 is attached via attachment screws 13 in front housing part 3*a*. The two housing parts 3*a*, 3*b* are connected with the aid of connecting screws 14. Front housing part 3*a* has a circumferential slot 15, i.e. a slot that extends over the entire circumference, which is limited in the axial direction by two radial planes E1, E2. The distance between the two planes E1, E2, i.e., the axial depth of the slot, is slightly larger than the wall thickness of flange ring 7—as illustrated in the view in the drawing. This is advantageous for cooling clutch 1. Planes E1, E2 each include the stop faces for attachment tabs 7*a* in the area of attachment niches 9, 11.

Due to slot 15, it is possible to rotate flange ring 7, and thus fan 2, relative to clutch housing 3, provided that the flange ring is not fixed in place in the circumferential direction by attachment screws 8, 13. This means that fan 2 may be first mounted on front housing part 3*a* from the front (see FIG. 1), subsequently rotated by 30° (pitch) in the circumferential direction relative to clutch housing 3 within slot 15 and finally removed from the rear (see FIG. 4). Fan 2 or flange ring 7 may thus be "inserted" through clutch 1—or clutch 1 may be "inserted" through fan 2. For example, this means that fan 2 may be mounted from the front and attached from the rear and vice versa.

Figure 5:
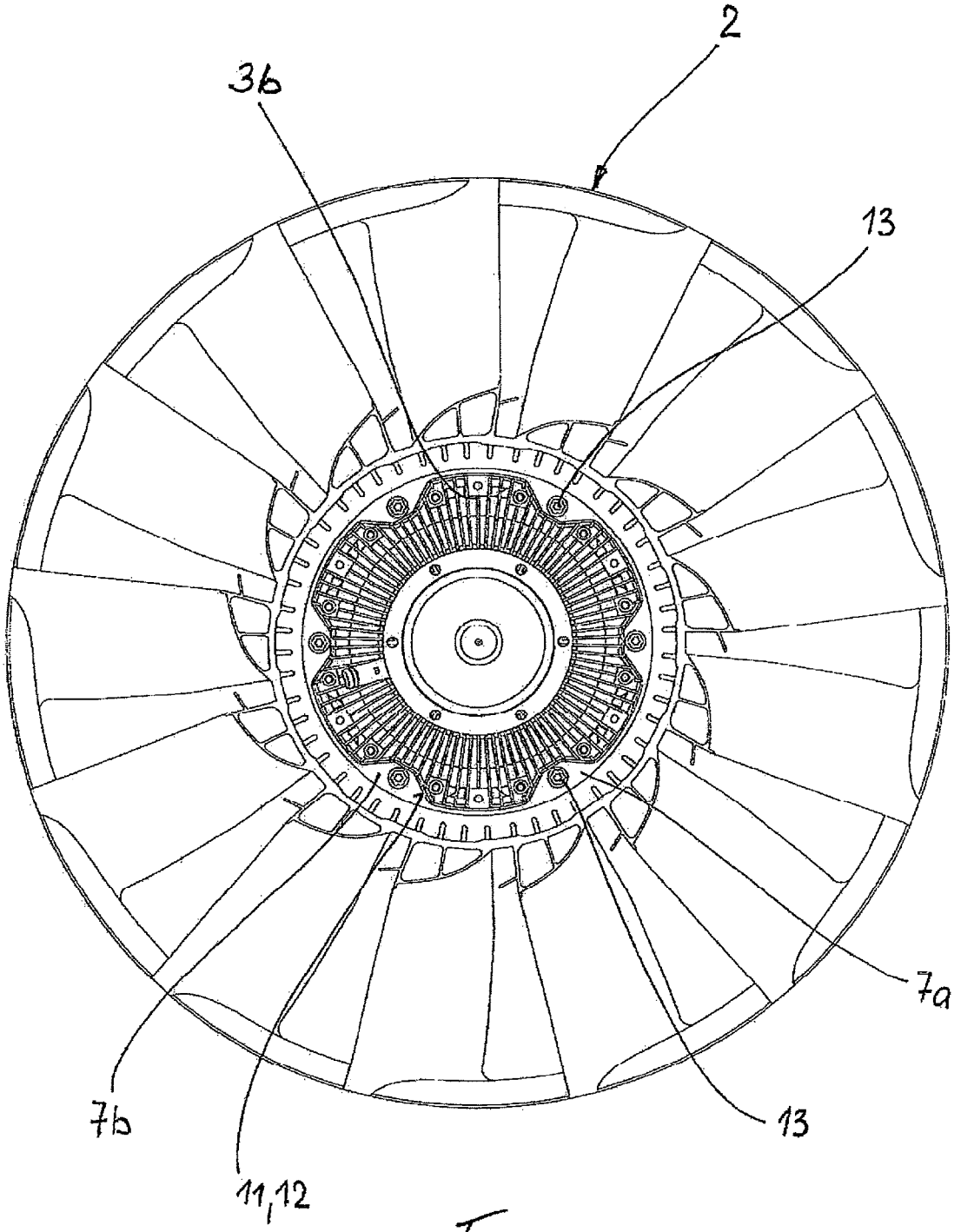
FIG. 5 shows a view in direction Y of the back of the clutch according to FIG. 4.

FIG. 5 shows a view of fan 2 according to FIG. 4 in the direction of arrow Y, i.e. toward the back of fan 2 and rear housing part 3*b*. The view shows that the outer profile of rear housing part 3*b* matches the inner profile of flange ring 7. It is therefore possible to either mount or remove flange ring 7 from the back. The six attachment niches 11 and 12 are offset by 30° relative to attachment niches 9 (see FIG. 1), i.e. the attachment bores (not illustrated) for attachment screws 13 have the same pitch and pitch diameter as the bores for attachment screws 8 (see FIG. 1).

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A fan clutch comprising:

a flange ring configured to removably attach a fan to the fan clutch; and a housing that comprises a first front housing part and a second rear housing part to which the flange ring is attachable via connecting elements;

wherein the housing has circumferential attachment niches that are provided in an offset manner in a circumferential direction on a front as well as on a back of the housing and into which attachment tabs situated on the flange ring are insertable either from the front of the fan clutch or from the back thereof, the attachment niches comprising recesses that are directed radially toward a center of the housing.

2. The fan clutch according to claim 1, wherein front attachment niches are provided in the front housing part.

3. The fan clutch according to claim 1, wherein rear attachment niches are provided in the front and rear housing parts.

4. The fan clutch according to claim 1, wherein the attachment niches have stop faces which are provided in radial planes and on which the attachment tabs are fixable in an axial direction.

5. The fan clutch according to claim 1, wherein the flange ring has an inner diameter that is greater than an outer diameter of the fan clutch and wherein the attachment tabs extend radially towards the inside from the inner diameter.

6. The fan clutch according to one claim 1, wherein a front attachment of the flange ring or of attachment tabs of the flange ring is performed via the front housing part, and wherein the first and the second housing parts are connectable to each other by the connecting elements.

7. The fan clutch according to claim 1, wherein the fan clutch is configured as a fluid friction clutch.

8. The fan clutch according to claim 7, wherein the fan clutch is driven by an internal combustion engine of a motor vehicle.

9. The fan clutch according to claim 8, wherein the fan clutch is connected to a crankshaft of the internal combustion engine.

10. The fan clutch according to claim 1, wherein the attachment niches are evenly distributed along an entire circumference of the housing.

11. The fan clutch according to claim 1, wherein the attachment tabs have a same contour as the attachment niches.

12. The fan clutch according to claim 1, wherein an inner profile of the flange ring matches an outer profile of the housing so that the flange ring and the housing fit together in an axial direction.

13. A fan clutch comprising:

a flange ring configured to removably attach a fan to the fan clutch;

a housing that comprises a first front housing part and a second rear housing part to which the flange ring is attachable via connecting elements; and a circumferential slot extending over an entire circumference of the front housing part, wherein the housing has circumferential attachment niches that are provided in an offset manner in a circumferential direction on a front as well as on a back of the housing and into which attachment tabs situated on the flange ring are insertable either from the front of the fan clutch or from the back thereof.

14. A fan clutch comprising:

a flange ring configured to removably attach a fan to the fan clutch; and a housing that comprises a first front housing part and a second rear housing part to which the flange ring is attachable via connecting elements;

wherein the housing has circumferential attachment niches that are provided in an offset manner in a circumferential direction on a front as well as on a back of the housing and into which attachment tabs situated on the flange ring are insertable either from the front of the fan clutch or from the back thereof, and wherein a distance between radial places, in which stop faces of the front and rear attachment niches are provided, corresponds approximately to an axial wall thickness of the flange ring or to attachment tabs of the flange ring.

15. A fan clutch comprising:

a flange ring configured to removably attach a fan to the fan clutch; and a housing that comprises a first front housing part and a second rear housing part to which the flange ring is attachable via connecting elements;

wherein the housing has circumferential attachment niches that are provided in an offset manner in a circumferential direction on a front as well as on a back of the housing and into which attachment tabs situated on the flange ring are insertable either from the front of the fan clutch or from the back thereof, and wherein a rear attachment of the flange ring or attachment tabs of the flange ring is performed via the front housing part with the aid of the connecting elements.

16. A fan clutch comprising:

a flange ring configured to removably attach a fan to the fan clutch; and a housing that comprises a first front housing part and a second rear housing part to which the flange ring is attachable via connecting elements;

wherein the housing has circumferential attachment niches that are provided in an offset manner in a circumferential direction on a front as well as on a back of the housing and into which attachment tabs situated on the flange ring are insertable either from the front of the fan clutch or from the back thereof, and wherein a circumferential slot is provided between first and second radial planes.

* * * * *